US007793593B2

(12) United States Patent
Huang

(10) Patent No.: US 7,793,593 B2
(45) Date of Patent: Sep. 14, 2010

(54) HINGED GANTRY CRANE

(76) Inventor: Xiaodong Huang, 59 Chao-Wang Road, Hangzhou (CN) 310014

( * ) Notice: Subject to any disclaimer, the term of this patent is extended or adjusted under 35 U.S.C. 154(b) by 232 days.

(21) Appl. No.: 11/581,101

(22) Filed: Oct. 13, 2006

(65) Prior Publication Data

US 2007/0193972 A1 Aug. 23, 2007

(51) Int. Cl.
*B61D 1/00* (2006.01)

(52) U.S. Cl. ..... 105/163.1

(58) Field of Classification Search ..... 105/163.1, 105/163.2; 104/243–245; 212/276, 346
See application file for complete search history.

(56) References Cited

U.S. PATENT DOCUMENTS 5,492,067 A * 2/1996 Anderson ..... 105/163.2
5,575,220 A * 11/1996 van Soest et al. ..... 105/163.1
5,810,183 A * 9/1998 Feider et al. ..... 212/291
2002/0070870 A1 * 6/2002 Huang ..... 340/685

* cited by examiner

*Primary Examiner*—S. Joseph Morano
*Assistant Examiner*—Robert J McCarry, Jr.
(74) *Attorney, Agent, or Firm*—Kenyon & Kenyon LLP

(57) ABSTRACT

A gantry crane comprising a bridge communicating with a trolley. The two ends of the bridge are connected to a main column whose lower end is connected to rollers. Various hinged joints allow for movement of the components towards and away from each other which allows the crane to be assembled or disassembled without the need for elevated or hoisted operations.

6 Claims, 9 Drawing Sheets

HINGED GANTRY CRANE

TECHNICAL FIELD

Figure 1:
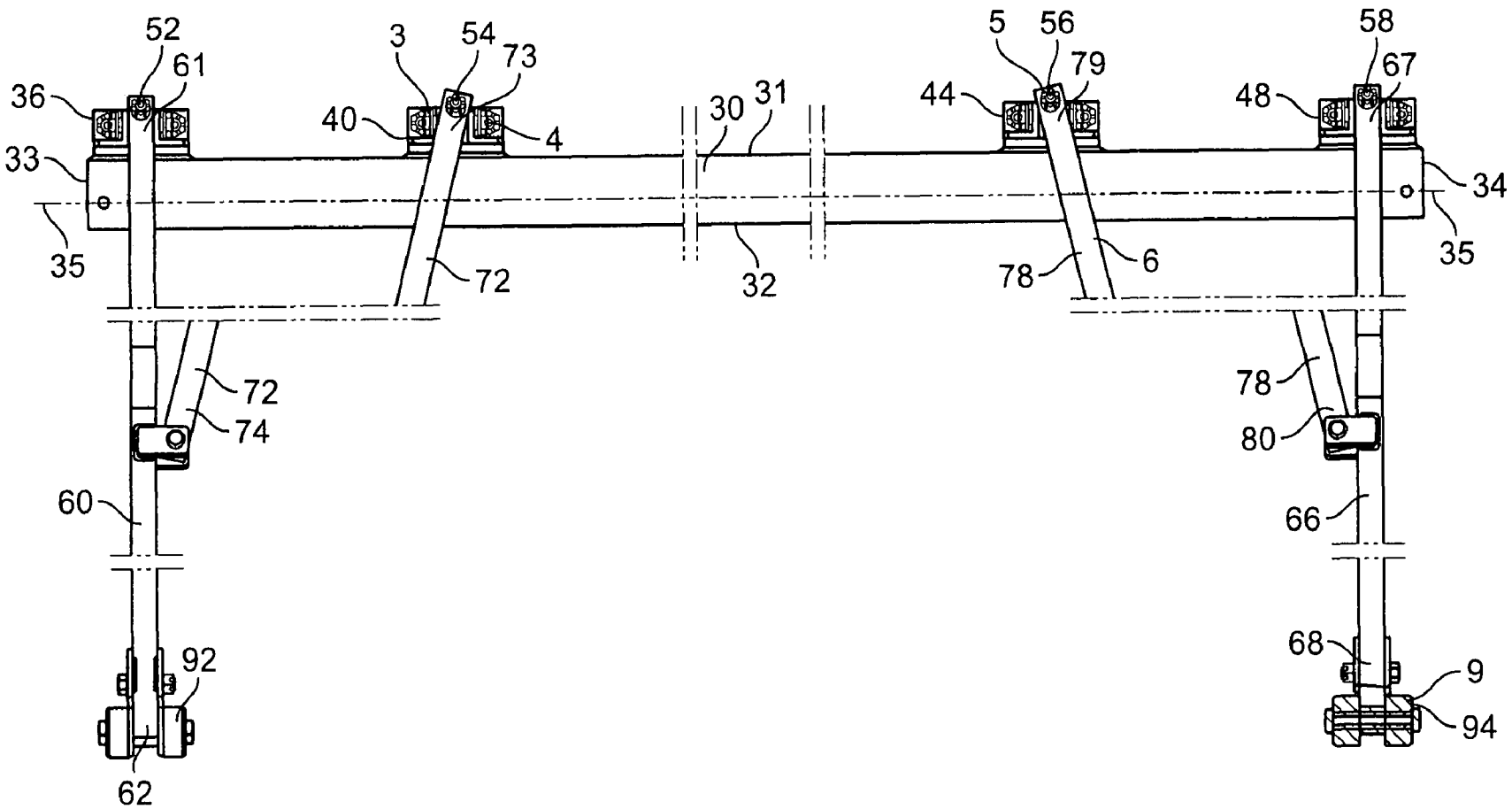

This invention involves cranes, in particular cranes equipped with trolleys that may move about on a movable gantry frame.

BACKGROUND TECHNOLOGY

Gantry cranes are composed of the bridge, the columns that are connected to the two ends of the bridge, the trolley on the bridge, and the manually operated or electrically operated load block. Due to structural reasons, existing gantry cranes are relatively tedious to assemble and dissemble; for example, the erection of the columns and the setting of the bridge both require high hoist operations, and the same for disassembly. This not only increases the work volume in assembly and disassembly, but also increases the amount of equipment used, and also impacts safety.

In an ideal situation, it would be possible to assemble and disassemble such cranes on the ground surface, without the need for hoisting and elevated operations, which will be safe and time-saving.

DETAILS OF THE INVENTION

This invention intends to solve the problem in existing gantry cranes in that their assembly and disassembly are tedious and time consuming, and that assembly and disassembly cannot be conducted on the ground surface. A type of gantry crane is provided for this reason, which can be assembled and disassembled on the ground surface, without the need for elevated and hoisted operations.

In order to resolve the issues described above, the technical solution utilized by this invention is that it is equipped with a bridge and the trolley emplaced thereupon, the two sides of the two ends of the bridge are each connected to a main column, upon which the supporting columns are connected, the upper ends of which are connected to the bridge, the lower end of the main posts are connected to rollers, the base columns are connected to the bottoms of the main columns connected to the two sides of the two ends of the bridge, the characteristics of which being that: the shoulder joints are connected on the bridge, the cross joints are attached to the top ends of the main columns and supporting columns; a main column being connected to each of the two sides of the two ends of the bridge as described refers to: the cross joints hinged to the tops of the main columns described are hinged to the shoulder joints; the upper ends of which supporting columns are connected to the bridge as described above refers to: the cross joints hinged to the tops of the supporting columns as described above are hinged to the shoulder joints.

That the shoulder joints are linked to the bridge described refers to: each of the two ends of the bridge is linked to a shoulder joint, and there is a joint in each of the two places extending from each of the two ends of the bridge towards the center for a distance. The shoulder joints described are composed of two shoulder joint sections including those parallel to each other and crossing the bridge at 90°; that the cross joints hinged to the tops of the main columns are hinged to the shoulder joints refers to where said cross joints are hinged to places between the two shoulder joint sections of the shoulder joints linked to the two ends of the bridge, and that the cross joints hinged to the tops of the supporting columns are hinged to the shoulder joints refers to where the cross joints are hinged to the two shoulder joint sections on each of the two shoulder joints linked to places extending for a certain distance from the ends of the bridge towards the center of the bridge.

That shoulder joints are connected to the bridge described refers to where connector plates are linked to the topside of the bridge, and where shoulder joints are connected to the connector plates.

That shoulder joints are connected to the bridge described refers to where the shoulder joints are fitted over the bridge.

That the undersides of the main columns are fitted with rollers refers to where ankle joints are linked to the undersides of the main columns, on the undersides of which are fitted rollers.

Hinged as described in this invention may refer to hinging through a combination of threaded bolts and nuts. The hinging of the main columns, support columns, and the cross joints described, and the hinging of the cross joints and the shoulder joints as described, are connected through combining and tightening of threaded bolts and nuts. Since the main columns are sufficiently long, the force applied at an opposing or contrasting direction can create large torque, causing the point of connection between the cross joint and the shoulder joint to pivot with the connecting bolt at this location as the rotating axis, causing the bottoms of the main columns on the two sides of one end of the bridge to move closer to or further from each other, and similarly for the main columns on the two sides of the other end of the bridge; in fact, due to the combination of the threaded bolts and nuts, tightening will be mirrored, and where mirrored loosening is concerned, pivoting may be produced when there is sufficient torque, and under these conditions, it can be ensured that the structural stability and components of this invention will not be damaged. The supporting columns in this invention are always maintained on the same plane as the main columns, which refers to the plane on which the two main columns on the same end of the bridge are located. The bottoms of the supporting columns are connected to the main columns, and the tops of the supporting columns are connected to the shoulder joints through the cross joint; as the bottoms of the main columns on the two sides of one end of the bridge move closer to or further apart from each other, the supporting columns will move along with the main columns, since the tops of the supporting columns are linked to the shoulder joints through the cross joints, and its pivoting movement is similar to that of the main columns. Due to the ability to create this pivoting action, i.e. that the bottoms of the main columns on the two sides of one end of the bridge moving closer to or further apart from each other can be accomplished, this invention can be assembled or disassembled on the ground surface.

When assembling, the bridge can be placed on two holding plates or holding frames, causing such to be at a certain distance above the ground, then attaching the shoulder joints to the bridge, and attaching the cross joints to the shoulder joints, and attaching the main columns and supporting columns to the cross joints, connecting the bottoms of the supporting columns to the main columns, and attaching rollers to the bottoms of the main columns. Since the bridge is at a certain distance above the ground, the main columns on the two sides of one end of the bridge will be at an angle rather than on a straight line with those on the other end. As the bottoms of the two main columns on the two sides of the bridge are simultaneously pulled closer together by tractors or manually operated pulley assemblies, the tops of the upper columns will rise together with the bridge. Once a certain height has been reached, the bottom columns described are installed on the bottoms of the main columns on the two ends of the bridge. Disassembly can be conducted in reverse.

In addition, this invention can also take the form of folded assembly components, in order to facilitate storage, transportation, and subsequent assembly. Once the bottoms of the supporting columns are removed from the main columns, the bottoms of the main columns can be brought towards each other and further towards the bridge, and similarly for the supporting columns, causing the bridge, main columns, and the supporting columns to together form folded assembly components.

The bridge, main columns, supporting columns, shoulder joints, and cross joints in this invention can all be removed individually, forming independent components, and can be installed individually or in combination as pertinent.

Because the cross joints are hinged to the tops of the main columns and supporting columns, and the cross joints are hinged to the shoulder joints linked to the bridge, this invention can be assembled on the ground surface, and, once the assembly of the pertinent parts and components have been completed, installing the bottom column after the required [height] has been achieved through pulling the bottoms of the main columns on the two ends of the bridge and causing such to draw together, to complete the assembly and setup of this invention. It is feasible to keep the bridge horizontal while pulling on the main columns on the two sides of the two ends of the bridge, such as to prevent the monorail trolley from sliding. Disassembly of this invention can be conducted in reverse, completing the disassembly on the ground surface. This invention can be assembled and disassembled on the ground surface, without the need for hoisting and elevated operations, and it is safe, convenient, and time-saving.

DESCRIPTIONS OF ATTACHED DRAWINGS

Drawing 1 is a structural diagram of an implementation of this invention;

Drawing 2 is a top view drawing of Drawing 1;

Drawing 3 is the left view drawing of Drawing 1;

Drawing 4 is an enlarged partial drawing of Drawing 2 including the shoulder joints;

Drawing 5 is a diagram of the shoulder joint component in Drawing 4;

Drawing 6 is the structural diagram of another implementation of this invention;

Drawing 7 is a top view drawing of Drawing 6;

Drawing 8 is the left view drawing of Drawing 6;

Drawing 9 is an enlarged partial drawing of Drawing 8 including the shoulder joints and cross joints;

Drawing 10 is an enlarged partial drawing of Drawing 6 including the shoulder joints;

Drawing 11 is a diagram of the shoulder joint component in Drawing 9.

The legend in the drawings are: 1 Bridge, 1-1 Connector Plate, 2 Shoulder Joint, 2-1 Shoulder joint component, 2-2 Supporting Plate, 2-3 Connector, 3 Nut, 4 Bolt, 5 Spring Type Pin, 6 Supporting Column, 7 Main Column, 8 Bolt, 9 Roller, 10 Bolt, 11 Nut, 12 Cross Joint, 13 Stopper, 14 Bottom Column, 15 Support Sleeve, 16 Ankle Joint, 17 Double sided bolt, 18 Cover Plate,

EXAMPLE OF AN IMPLEMENTATION 1

For this example of the gantry crane, see Drawing 1-Drawing 5, bridge with H beam 1, on which is emplaced a trolley, from the underside of which is suspended a pulley assembly for hauling, and the two ends of the bridge equipped with stoppers 13; connector plates 1-1 are linked to the tops of the two ends of the bridge and the places extending from the two ends of the bridge towards the center, the shoulder joints 2 are linked to the connector plates 1-1, the shoulder joints 2 are composed of two shoulder joint components 2-1 using steel angles, the center of the lower section of the shoulder joint component is grooved and two supporting plates 2-2 bored through the center are welded to the sides of the groove, supporting plates 2-2 are connected to the connector plate 1-1 through a combination of threaded bolts and nuts; cross joints 12 are linked to the shoulder joints 2 through a combination of bolts 4 and nuts 3 and locked in place with spring type pin, the outer end of the cross joint 12 is threaded and connected to main columns 7 and supporting columns 6 in combination with nuts, and locked in place with spring type pin 5, the bottoms of the supporting columns 6 are linked to the supporting plates installed on the main columns through a combination of bolts (8) and nuts; rollers 9 are linked to the bottoms of the main columns; and the bottom columns 14 are linked to the bottoms of the main columns on the two sides of one end and the other end of the bridge.

Figure 2:
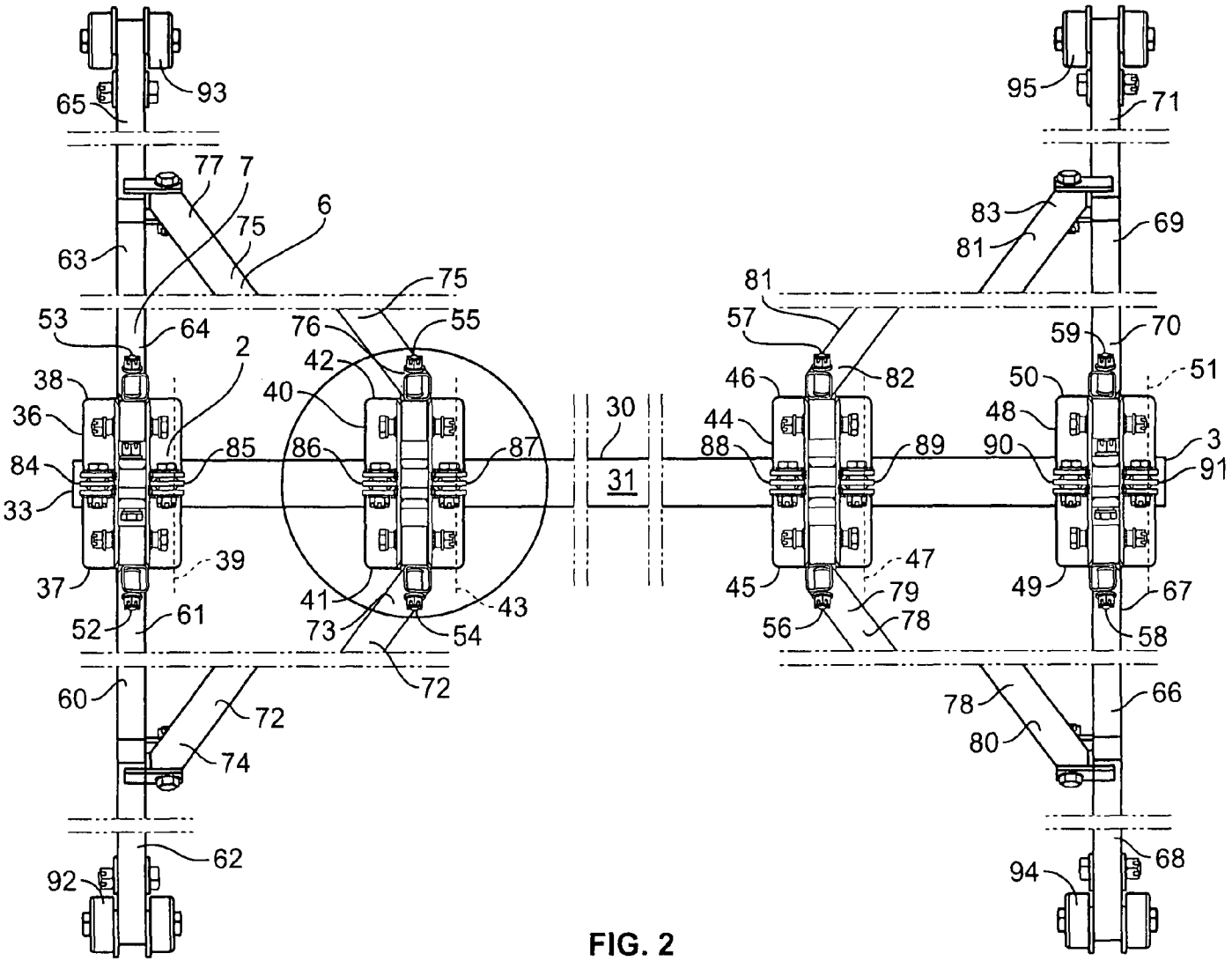
Figure 3:
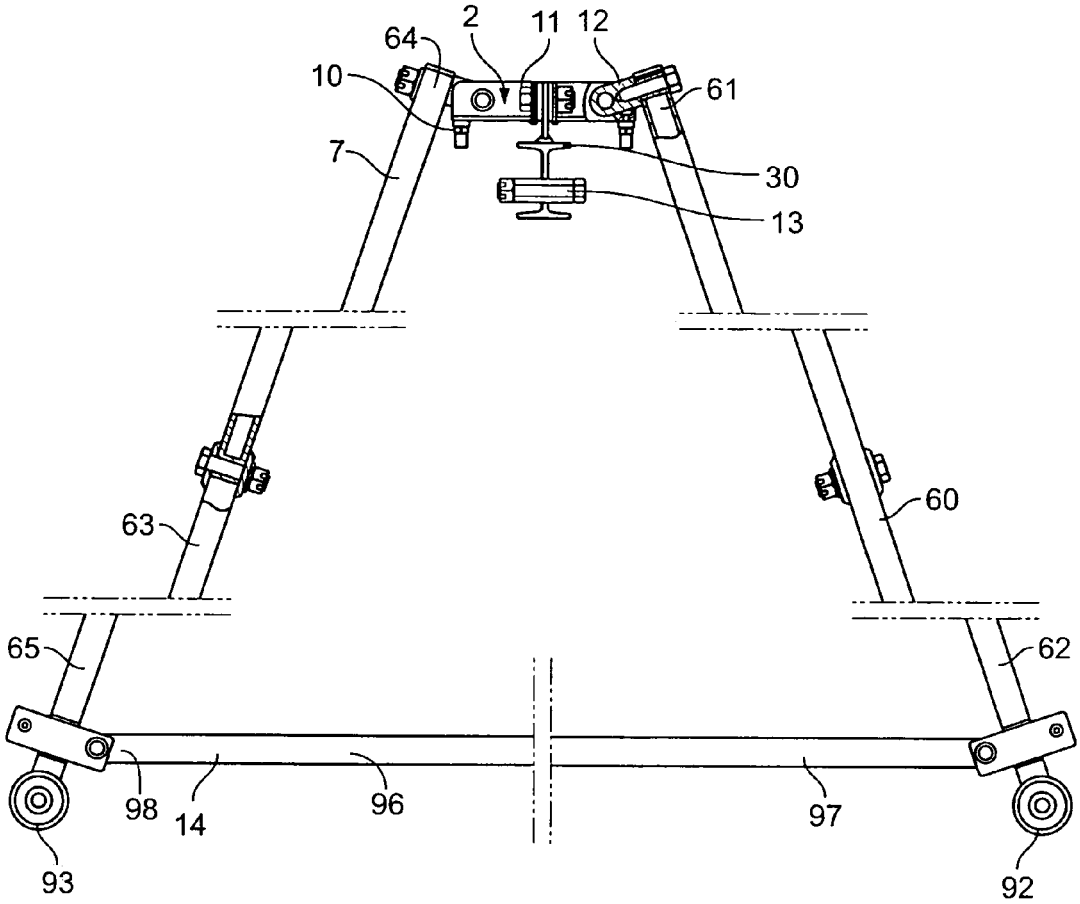
Figure 4:
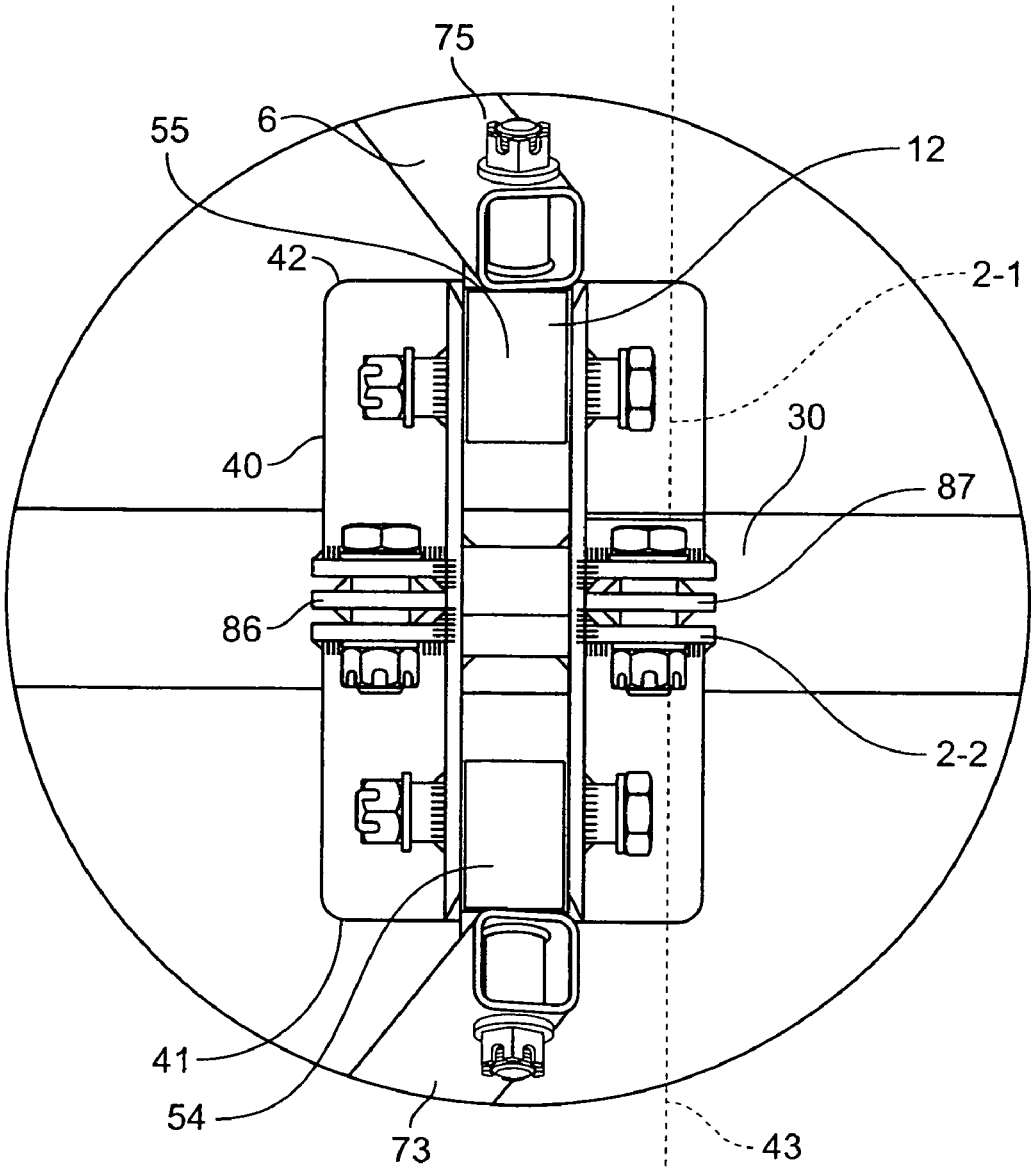
Figure 5:
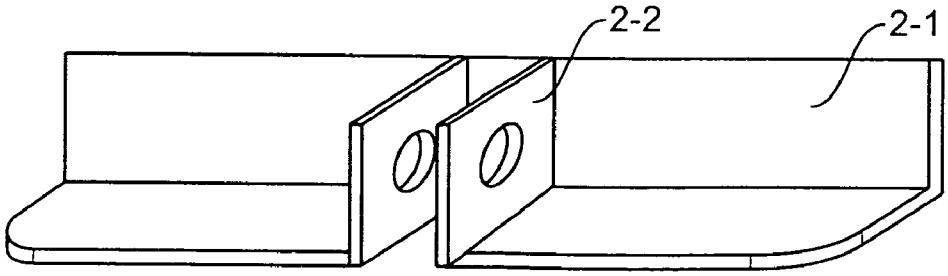
Figure 6:
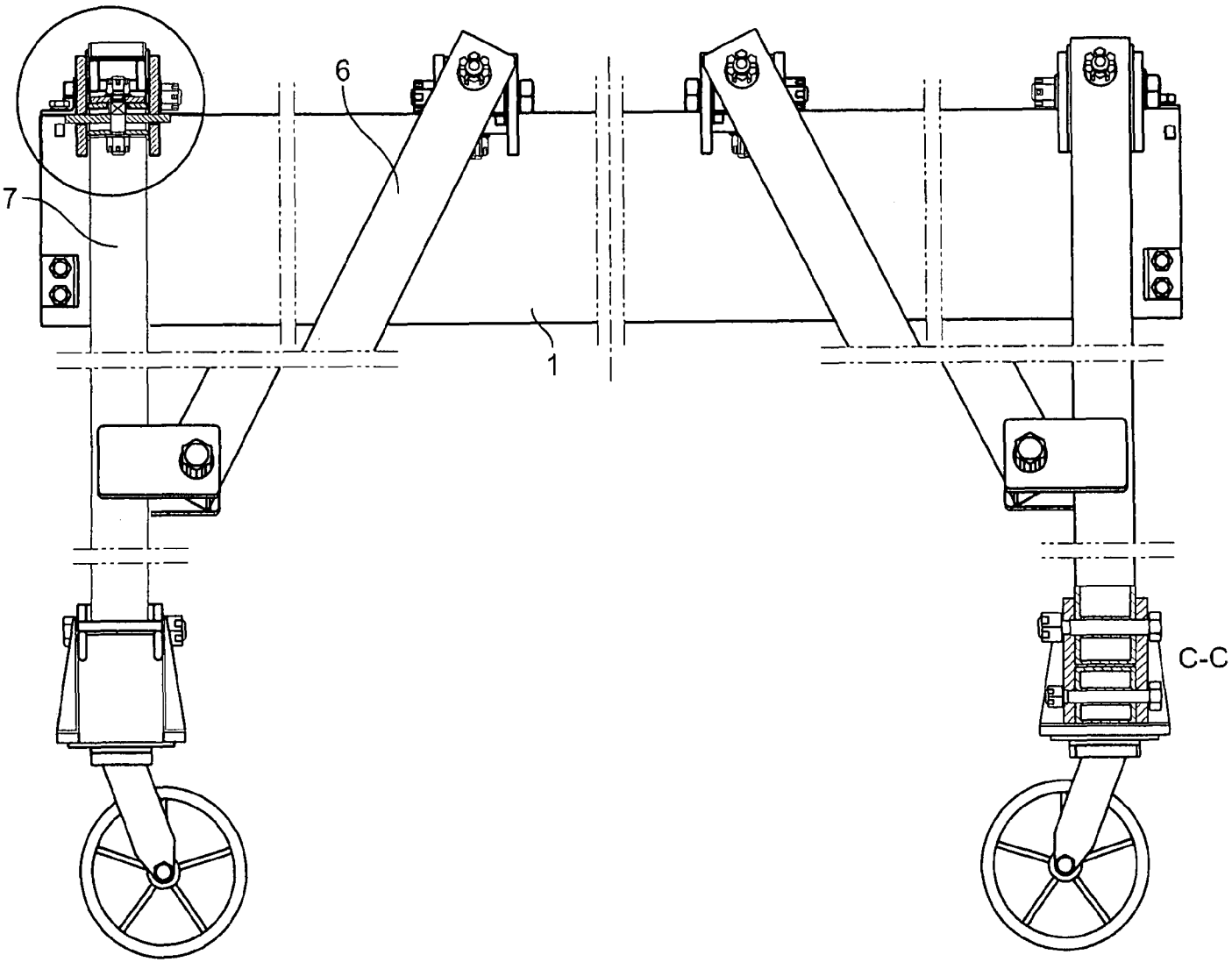
Figure 7:
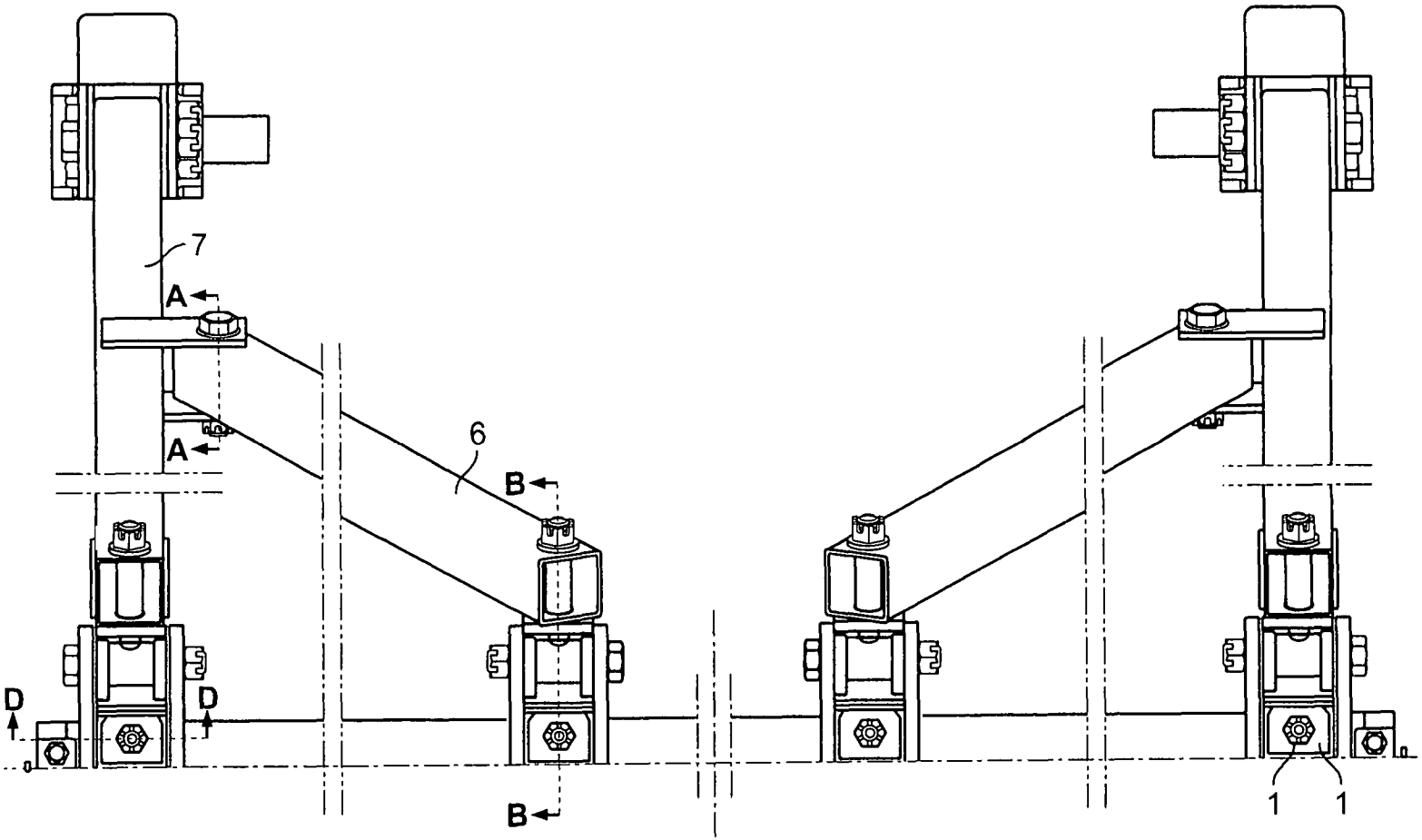
Figure 8:
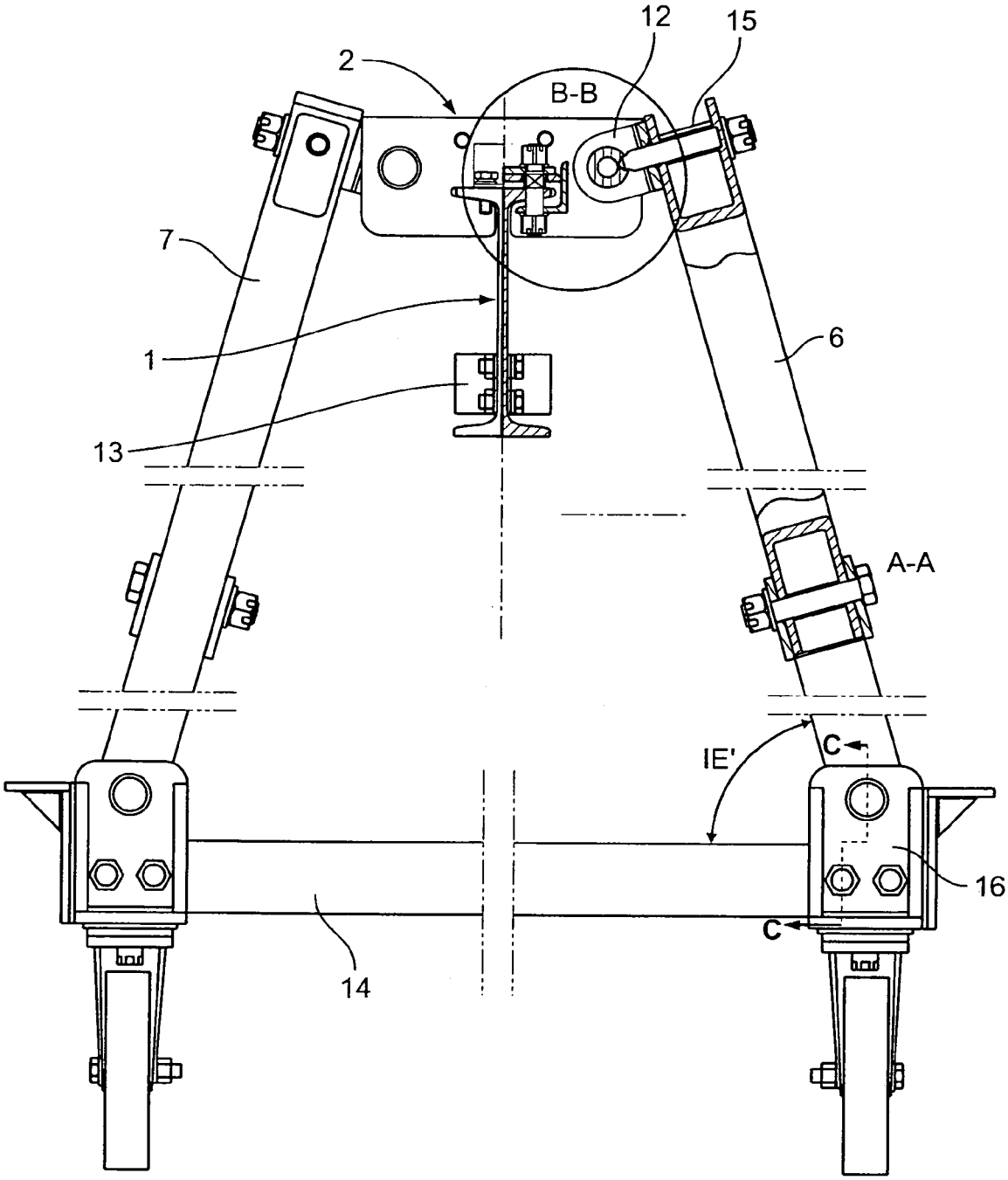
Figure 9:
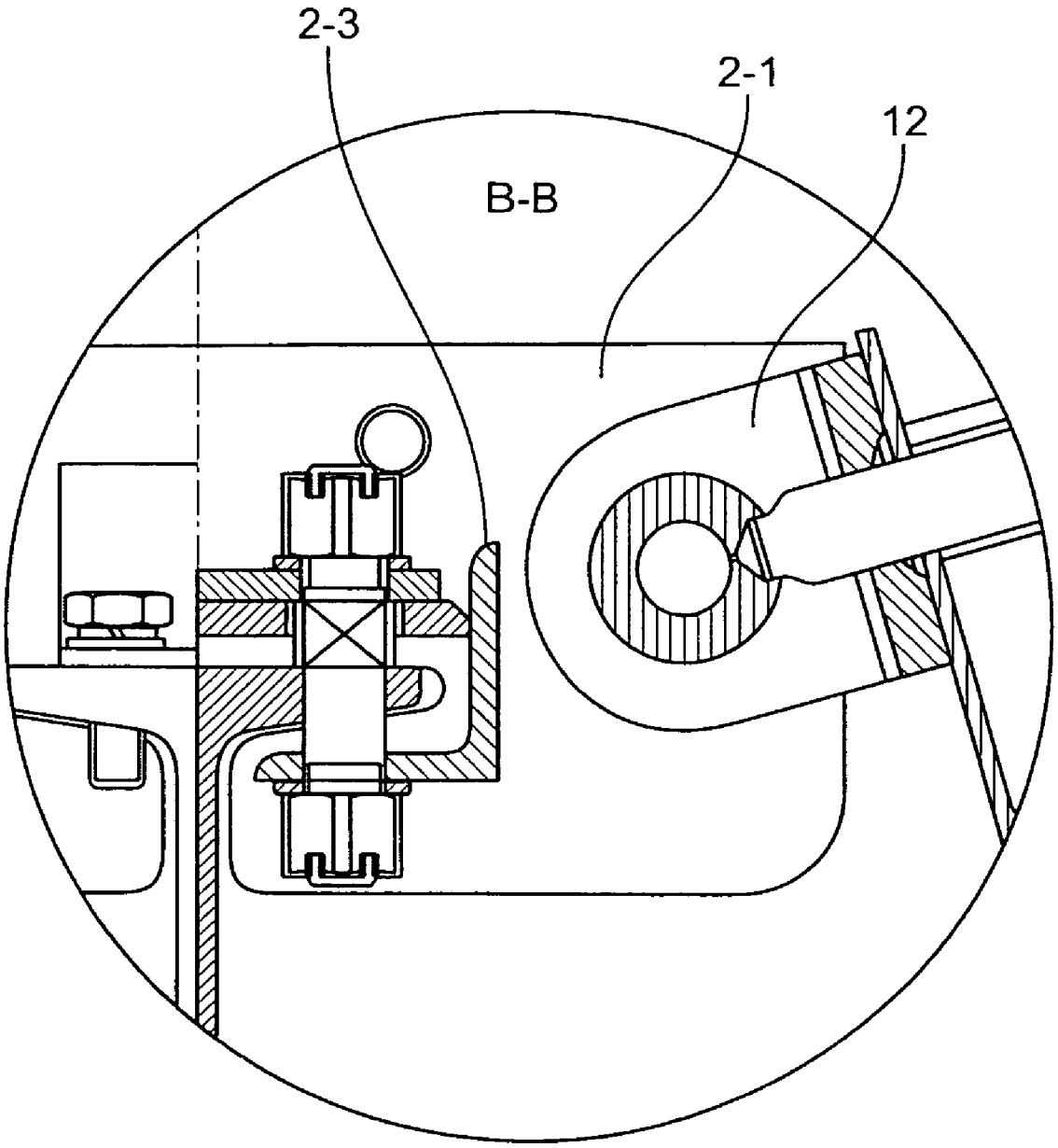
Figure 10:
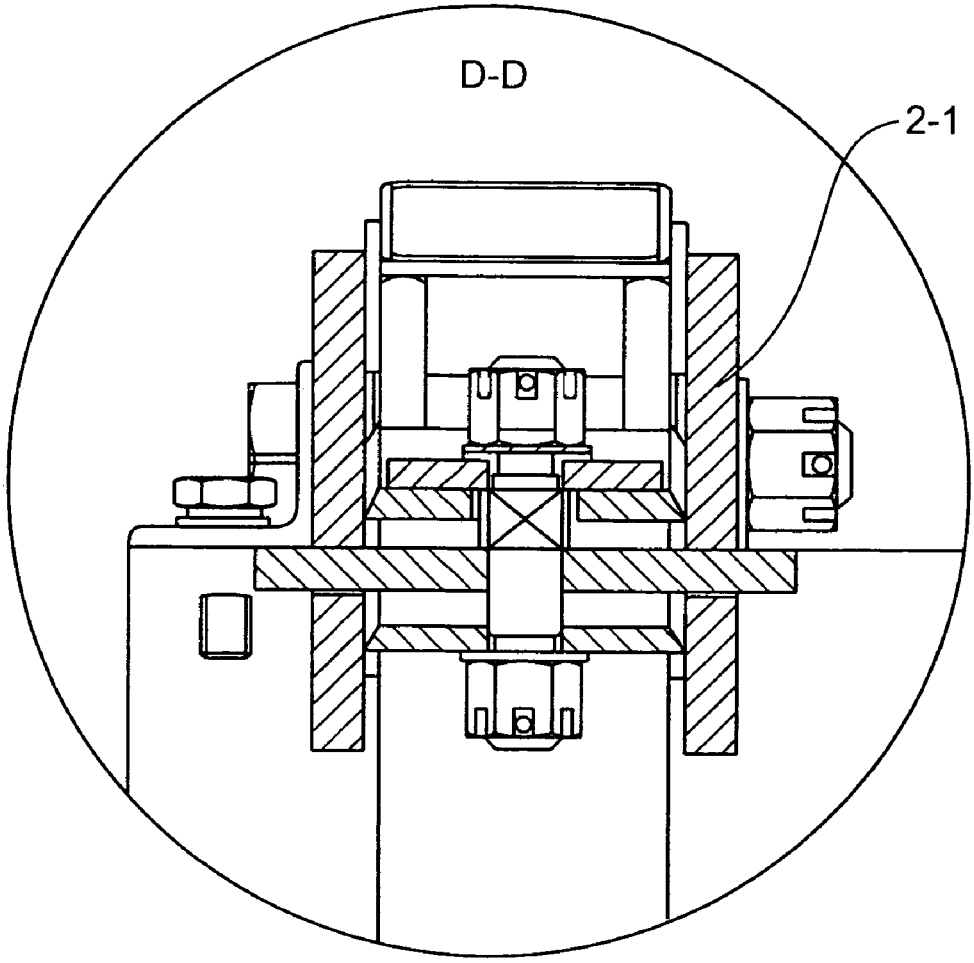
Figure 11:
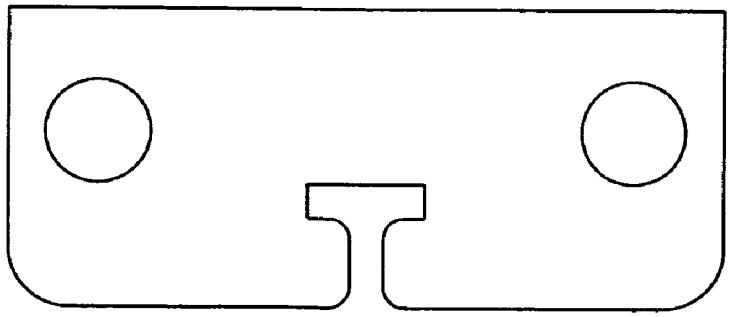

As shown in FIGS. 1 to 4, applicant's invention can also be described as a gantry crane, comprising a longitudinal bridge 30 having a top surface 31 and a bottom surface 32 and a proximal end 33 and a distal end 34 and a longitudinal axis 35.

A first shoulder joint 36 is removably attached at the proximal end 33 of the bridge 30. The first shoulder joint 36 has a first end 37 and a second end 38 and a longitudinal axis 39.

A second shoulder joint 40 is removably attached on the bridge 30 and is located distal to the first shoulder joint 36. The second shoulder joint 40 has a first end 41 and a second end 42 and a longitudinal axis 43.

A third shoulder joint 44 is removably attached on the bridge 30 and is located distal to the second shoulder joint 40. The third shoulder joint 44 has a first end 45 and a second end 46 and a longitudinal axis 47.

A fourth shoulder joint 48 is removably attached at the distal end 34 of the bridge 30. The fourth shoulder joint 48 has a first end 49 and a second end 50 and a longitudinal axis 51.

A first cross joint 52 is hingedly connected to the first end 37 of the first shoulder joint 36.

A second cross joint 53 is hingedly connected to the second end 38 of the first shoulder joint 36.

A third cross joint 54 is hingedly connected to the first end 41 of the second shoulder joint 40.

A fourth cross joint 55 is hingedly connected to the second end 42 of the second shoulder joint 40.

A fifth cross joint 56 is hingedly connected to the first end 45 of the third shoulder joint 44.

A sixth cross joint 57 is hingedly connected to the second end 46 of the third shoulder joint 44.

A seventh cross joint 58 is hingedly connected to the first end 49 of the fourth shoulder joint 48.

An eighth cross joint 59 is hingedly connected to the second end 50 of the fourth shoulder joint 48.

A first main column 60 is provided and has a first end 61 and a second end 62 with the first end 61 removably connected to the first cross joint 52.

A second main column 63 is provided and has a first end 64 and a second end 65 with the first end 64 removably connected to the second cross joint 53.

A third main column 66 is provided and has a first end 67 and a second end 68 with the first end 67 removably connected to the seventh cross joint 58.

A fourth main column 69 is provided and has a first end 70 and a second end 71 with the first end 70 removably connected to the eighth cross joint 59.

A first supporting column 72 is provided and has a first end 73 and a second end 74 with the first end 73 removably connected to the third cross joint 54 and the second end 74 removably connected to the first main column 60.

A second supporting column 75 is provided and has a first end 76 and a second end 77 with the first end 76 removably connected to the fourth cross joint 55 and the second end 77 removably connected to the second main column 63.

A third supporting column 78 is provided and has a first end 79 and a second end 80 with the first end 79 removably connected to the fifth cross joint 56 and the second end 80 removably connected to the third main column 66.

A fourth supporting column 81 is provided and has a first end 82 and a second end 83 with the first end 82 removably connected to the sixth cross joint 57 and the second end 83 removably connected to the fourth main column 69.

In a preferred embodiment the longitudinal axes 39,43,47, 51 of the first 36, second 40, third 44 and fourth 48 shoulder joints are substantially parallel to each other and substantially perpendicular to the longitudinal axis 35 of the bridge 30.

The gantry crane may also be provided with a first 84, a second 85, a third 86, a fourth 87, a fifth 88, a sixth 89, a seventh 90, and an eighth 91 connector plate attached to the top surface 31 of the bridge 30. In this embodiment, the first shoulder joint 36 is removably connected to the first 84 and second 85 connector plates; the second shoulder joint 40 is removably connected to the third 86 and fourth 87 connector plates; the third shoulder joint 44 is removably connected to the fifth 88 and sixth 89 connector plates, and the fourth shoulder joint 48 is removably connected to the seventh 90 and eighth 91 connector plates.

In a preferred embodiment, the first 36, second 40, third 44 and fourth 48 shoulder joints are disposed on the top surface 31 of the bridge 30.

The gantry crane may be provided with a first roller 92 disposed on the second end 62 of the first main column 60, a second roller 93 disposed on the second end 65 of the second main column 63, a third roller 94 disposed on the second end 68 of the third main column 66, and a fourth roller 95 disposed on the second end 71 of the fourth main column 69.

A first base column 96 having a first end 97 and a second end 98 is provided. The first end 97 of the first base column 96 is removably connected to the second end 62 of the first main column 60, and the second end 98 of the first base column 96 is removably connected to the second end 65 of the second main column 63.

A second base column 99 having a first end 100 and a second end 101 is provided. The first end 100 of the second base column 99 is removably connected to the second end 68 of the third main column 66, and the second end 101 of the second base column 99 is removably connected to the second end 71 of the fourth main column 69.

AN EXAMPLE OF AN IMPLEMENTATION 2

For this example of the gantry crane, see Drawing 6-Drawing 11, bridge with H beam 1, on the upper wing edges of the bridge are installed shoulder joints 2, shoulder joints 2 are formed by welding the two shoulder joint components 2-1 which are grooved on the underside and bored on the two ends through the connector using steel angles, across the top of which connectors 2-3 the cover plate 18 is linked, equipped with double-sided bold 17 that passes through the connector 2-3, the upper wing edges of the bridge, and the cover plate 18, and fastened in combination with the nuts; the cross joints 12 are linked on the shoulder joints through the combination of bolts and nuts, and the main columns 7 and supporting columns 6 are linked to the outer ends of the cross joints through bolts and support sheaths 15, ankle joints 16 are linked to the bottoms of the main columns with four faced compound plates through a combination of bolts and nuts, and rollers 9 are linked to the bottoms of the ankle joints; the remainder of the structure is the same as that for the above example. The gantry crane in this example is suitable for hoisting objects of greater weight as compared to example 1.

The invention claimed is:

1. A gantry crane, comprising:

a longitudinal bridge having a top surface and a bottom surface and a proximal end and a distal end and a longitudinal axis;

a first shoulder joint removably attached at the proximal end of the bridge, the first shoulder joint having a first end and a second end and longitudinal axis, a second shoulder joint removably attached on the bridge and distal to the first shoulder joint, the second shoulder joint having a first end and a second end a longitudinal axis, a third shoulder joint removably attached on the bridge and distal to the second shoulder joint, the third shoulder joint having a first end and a second end and a longitudinal axis, a fourth shoulder joint removably attached at the distal end of the bridge, the fourth shoulder joint having a first end and a second end and a longitudinal axis, a first cross joint hingedly connected to the first end of the first shoulder joint, the first cross joint movable in a first direction substantially parallel to the longitudinal axis of the longitudinal bridge and also movable in a second direction substantially perpendicular to the longitudinal axis of the longitudinal bridge;

a second cross joint hingedly connected to the second end of the first shoulder joint, the second cross joint movable in a first direction substantially parallel to the longitudinal axis of the longitudinal bridge and also movable in a second direction substantially perpendicular to the longitudinal axis of the longitudinal bridge;

a third cross joint hingedly connected to the first end of the second shoulder joint, the third cross joint movable in a first direction substantially parallel to the longitudinal axis of the longitudinal bridge and also movable in a second direction substantially perpendicular to the longitudinal axis of the longitudinal bridge;

a fourth cross joint hingedly connected to the second end of the second shoulder joint, the fourth cross joint movable in a first direction substantially parallel to the longitudinal axis of the longitudinal bridge and also movable in a second direction substantially perpendicular to the longitudinal axis of the longitudinal bridge;

a fifth cross joint hingedly connected to the first end of the third shoulder joint, the fifth cross joint movable in a first direction substantially parallel to the longitudinal axis of the longitudinal bridge and also movable in a second direction substantially perpendicular to the longitudinal axis of the longitudinal bridge;

a sixth cross joint hingedly connected to the second end of the third shoulder joint, the sixth cross joint movable in a first direction substantially parallel to the longitudinal axis of the longitudinal bridge and also movable in a second direction substantially perpendicular to the longitudinal axis of the longitudinal bridge;

a seventh cross joint hingedly connected to the first end of the fourth shoulder joint, the seventh cross joint movable in a first direction substantially parallel to the longitudinal axis of the longitudinal bridge and also movable in a second direction substantially perpendicular to the longitudinal axis of the longitudinal bridge;

an eighth cross joint hingedly connected to the second end of the fourth shoulder joint, the eighth cross joint movable in a first direction substantially parallel to the longitudinal axis of the longitudinal bridge and also movable in a second direction substantially perpendicular to the longitudinal axis of the longitudinal bridge;

a first main column, having a first end and a second end, the first end removably connected to the first cross joint;

a second main column having a first end and a second end, the first end removably connected to the second cross joint;

a third main column having a first end and a second end, the first end removably connected to the seventh cross joint;

a fourth main column having a first end and a second end, the first end removably connected to the eighth cross joint;

a first supporting column having a first end and a second end, the first end removably connected to the third cross joint and the second end removably connected to the first main column;

a second supporting column having a first end and a second end, the first end removably connected to the fourth cross joint and the second end removably connected to the second main column;

a third supporting column having a first end and a second end, the first end removably connected to the fifth cross joint and the second end removably connected to the third main column;

a fourth supporting column having a first end and a second end, the first end removably connected to the sixth cross joint and the second end removably connected to the fourth main column;

a first base column having a first end and a second end, the first end of the first base column removably connected to the second end of the first main column, and the second end of the first base column removably connected to the second end of the second main column; and a second base column having a first end and a second end, the first end of the second base column removably connected to the second end of the third main column, and the second end of the second base column removably connected to the second end of the fourth main column;

wherein, prior to the attachment of the second ends of the supporting columns to the main columns, the cross joints allow the supporting columns and the main columns to move in a first direction substantially parallel to the longitudinal axis of the longitudinal bridge and also to move in a second direction substantially perpendicular to the longitudinal axis of the longitudinal bridge; and wherein, after the attachment of the second ends of the supporting columns to the main columns, the cross joints do not allow the supporting columns and the main columns to move in the first direction substantially parallel to the longitudinal axis of the longitudinal bridge and do allow the supporting columns and the main columns to move in the second direction substantially perpendicular to the longitudinal axis of the longitudinal bridge.

2. The gantry crane of claim 1, wherein the longitudinal axes of the first, second, third and fourth shoulder joints are substantially parallel to each other and substantially perpendicular to the longitudinal axis of the bridge.

3. The gantry crane of claims 1 or 2, further comprising a first, a second, a third, a fourth, a fifth, a sixth, a seventh, and an eighth connector plate attached to the top surface of the bridge, the first shoulder joint removably connected to the first and second connector plates, the second shoulder joint removably connected to the third and fourth connector plates, the third shoulder joint removably connected to the fifth and sixth connector plates, and the fourth shoulder joint removably connected to the seventh and eighth connector plates.

4. The gantry crane of claims 1 or 2, wherein the first, second, third and fourth shoulder joints are disposed on the top surface of the bridge.

5. The gantry crane of claim 3, further comprising a first roller disposed on the second end of the first main column, a second roller disposed on the second end of the second main column, a third roller disposed on the second end of the third main column, and a fourth roller disposed on the second end of the fourth main column.

6. The gantry crane of claim 1, further comprising a a plurality of bolts projecting from the bottom surface of the longitudinal bridge and disposed between the longitudinal bridge and the main columns to prevent the main columns from contacting the longitudinal bridge.

* * * * *